United States Patent [19]

Flemings et al.

[11] 4,205,983

[45] Jun. 3, 1980

[54] PROCESS FOR FORMING METAL COMPOSITIONS CONTAINING CELLULAR IN SITU COMPOSITES

[75] Inventors: Merton C. Flemings, Cambridge; Kenneth P. Young, Arlington, both of Mass.; Edmund M. Dunn, Walnut Creek, Calif.

[73] Assignee: Massachusetts Institute of Technology, Cambridge, Mass.

[21] Appl. No.: 924,094

[22] Filed: Jul. 12, 1978

Related U.S. Application Data

[63] Continuation of Ser. No. 818,190, Jul. 22, 1977, abandoned.

[51] Int. Cl.[2] ..... C22C 1/02

[52] U.S. Cl. ..... 75/135; 75/171

[58] Field of Search ..... 75/135, 170, 171

[56] References Cited

U.S. PATENT DOCUMENTS 3,915,761 10/1975 Tschinkel et al. ..... 75/171

OTHER PUBLICATIONS

Jackson et al., Conference on In Situ Composites, Aug. 1976, pp. 365–375, Xerox Individualized Publishing, Lexington, Massachusetts.

*Primary Examiner*—R. Dean

*Attorney, Agent, or Firm*—Arthur A. Smith, Jr.; Paul J. Cook

[57] ABSTRACT

A process for forming metal compositions containing cellular in situ composites. A metal composition containing at least 25 volume percent liquid is cooled to produce aligned columnar dendrite growth. The resultant composition then is subjected to isothermal coarsening in the semi-solid temperature range to form the cellular in situ composites. This composition then is solidified. The metal compositions are particularly useful in rotating machinery.

4 Claims, 5 Drawing Figures

PROCESS FOR FORMING METAL COMPOSITIONS CONTAINING CELLULAR IN SITU COMPOSITES

BACKGROUND OF THE INVENTION

The Government has rights in this invention pursuant to Grant No. DMR 74-144465 and IPA-0010 awarded by the National Science Foundation.

This is a continuation of application Ser. No. 818,190 filed July 22, 1977, abandoned.

This invention relates to a process for forming metal compositions referred to as cellular in situ composites.

As is well-known, the microscopic solid structure of metals is dictated primarily by the conditions of cooling under which the solid metal is formed from its liquid composition. Metal solidification begins at the wall of the mold containing the liquid metal and proceeds inward. At any given moment during solidification, one usually finds a solid zone, a zone of liquid metal and between them a zone where liquid metal is being transferred into the solid. In the art, this latter region is termed the mushy zone.

Only when the metal is extremely pure or when special control is exercised over solidification does one find a smooth interface between the solid zone and the liquid zone. If impurities or alloying substances are present, even in small amount, they tend to be rejected by the metal solidifying at the interface. They then lower the melting point of the liquid next to the growing solid and cause the interface to become unstable. As a result, the interface becomes jagged in that crystalline protrusions known as dendrites extend from the solid into the liquid. The shape of the dendrite or other solid protrusion depends upon the ratio of the thermal gradient in the metal (G) to the growth rate of the solid portion of the metal (R). When G/R is low, equiaxed dendritic and columnar dendritic metals are readily obtained. G/R ratios can be increased by adding heat at one end of a solidifying alloy while extracting heat at the other end. At intermediate values of G/R, cellular in situ composites appear. At high values of G/R, one obtains either of two plane front structures; either a single phase structure or a multiphase structure. As used herein, the term "cellular in situ composite(s)" refers to a columnar structure extending from the solid portion of a solidifying metal into the liquid portion and wherein the columns are substantially free of protruding arms along their length, which arms, for example, are found on columnar dendritic structures.

The plane front structures have been found generally to exhibit the most improved component life under a given set of temperatures or use conditions or have been found to perform satisfactorily at higher operating temperatures as compared to the other metal structures described above. However, the high temperature gradients, typically about 300° C./cm, and slow growth rates, less than 1 inch per hour, needed to form these plane front structures in most alloys of engineering interest are undesirably time consuming and expensive. It has been found that the cellular in situ composites exhibit only slightly inferior mechanical properties than the plane front structures. However, the temperature gradients and growth rates needed to form the cellular in situ composites directly also are undesirably time consuming and expensive thereby resulting in only limited commercial use for the metal compositions formed by these processes. Thus, the processing benefits to be gained in forming the cellular in situ composites directly are only minor and do not seem to justify pursuit of this approach on a commercial basis as, for example, in the production of turbine blades.

Accordingly, it would be desirable to provide a process for forming cellular in situ composites which does not require the high temperature gradients and low growth rates when forming the cellular in situ composites directly

SUMMARY OF THE INVENTION

In accordance with this invention, a process for forming cellular in situ composites is provided which eliminates the need for slow growth rates (R) and the need for high temperature gradients (G). The process comprises two basic stages: (1) initial aligned columnar dendritic growth at fast growth rates and low temperature gradients and (2) isothermal coarsening in the semi-solid temperature range. The columnar dendrites are grown first at rapid rates to promote fine interdendritic spacings. These structures then are held within the solid/liquid range for a period sufficiently long to permit coarsening and coalescence to transform the dendrites to cell-like structures, for instance, 15 to 30 minutes. The remaining liquid then is frozen thereby to form a solid composition.

DETAILED DESCRIPTIONS OF PREFERRED EMBODIMENTS

In the process of this invention, the initial aligned columnar dendritic growth is formed from the liquid or solid-liquid metal composition at fast rates of at least about 5 cm/hr, preferably at least about 25 cm/hr and at low temperature gradients of less than about 300° C./cm, preferable less than about 50° C./cm. The particular optimum temperature gradients and growth rates, more precisely, the optimum ratio of G/R as described above, utilized to form the desired aligned columnar dendritic growth will vary depending upon the particular alloy being treated in accordance with the process of this invention. The starting metal composition utilized in the present invention comprises at least about 25 volume percent liquid, preferably at least about 75 volume percent liquid in order to assure aligned columnar dendritic growth. After the columnar dendrites are formed, the metal composition is subjected to an isothermal coarsening step during which each dendrite initially is transformed into a plate-like structure. Thereafter, still during the isothermal coarsening step, each plate-like dendrite degenerates to form a plurality of smaller diameter solid cells or fibers, contrary to the expected approximate retention of the original dendrite size. This fiber multiplication mechanism appears to be the optimum means by which the metal system reduces its surface area to volume ration (Sv) which provides the driving force for the fiber multiplication process.

In the process of this invention, it is preferred that the density of solid fibers formed during the coarsening step be maximized since it has been found that the final metal composition is characterized by improved mechanical properties such as ultimate tensile strength, toughness and yield strength as a result thereof. It has been found that increased fiber density is obtained when utilizing relatively low temperature gradients and high initial growth rates during the initial step of forming the columnar dendrites. Thus, in the preferred aspect of this invention, the temperature gradient utilized is less than about 300° C./cm, preferably between about 0° C./cm and 50° C./cm with growth rates greater than about 5 cm/hr, preferably between about 25 cm/hr and 500 cm/hr. The isothermal coarsening step is conducted under the conditions set forth above. The liquid metal remaining after the coarsening step then is frozen.

Thus, the process of this invention provides a means for obtaining metal compositions having improved mechanical properties without the need for high thermal gradients or slow growth rates while forming the compositions. Thus, this process provides an economic means for forming highly desirable metal compositions.

Figure 1:
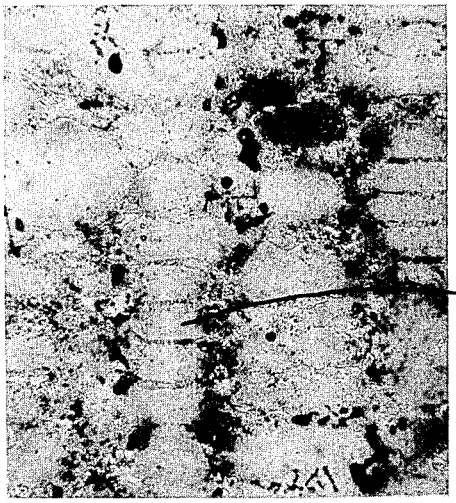
FIG. 1 is a longitudinal view photomicrograph, 100 times magnification of a directionally solidified metal composition useful as a starting material in the present invention.
Figure 2:
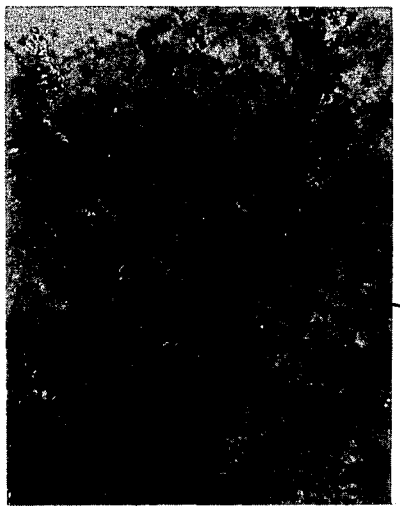
FIG. 2 is a transverse view photomicrograph, 100 times magnification of the composition of FIG. 1.
Figure 3:
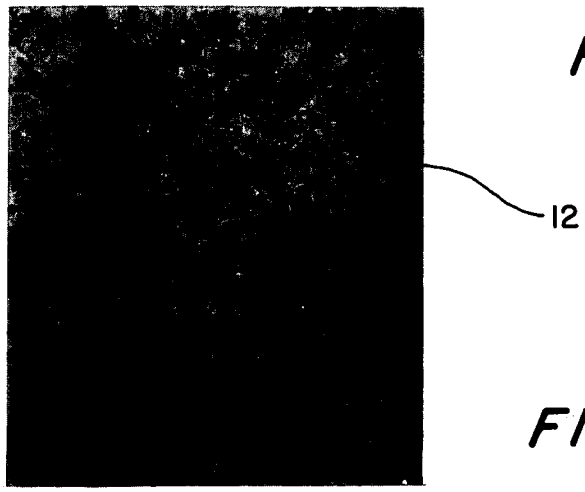
FIG. 3 is a transverse view photomicrograph, 100 times magnification of a metal composition prepared by the first step of this invention.
Figure 4:
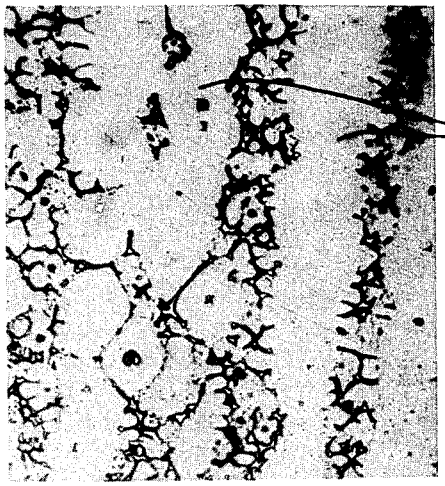
FIG. 4 is a longitudinal view photomicrograph, 100 times magnification of a metal composition prepared by the process of this invention.
Figure 5:
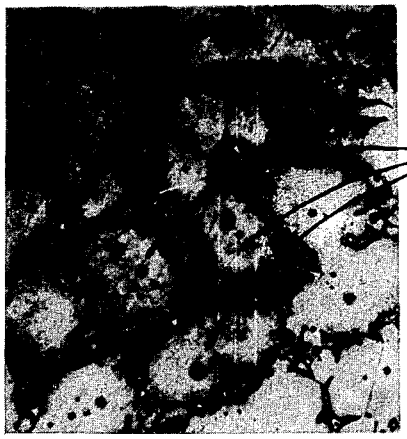
FIG. 5 is a transverse view photomicrograph of a metal composition of FIG. 4.

Referring to FIGS. 1 and 2, an airfoil section formed of Mar M200+Hafnium alloy dendrites 10 is show longitudinally in FIG. 1 and transversely in FIG. 2. The structure of FIG. 3 was obtained after the first step of the process of this invention of cooling at a fast growth rate and a low temperature gradient described in Example I. The structure comprises dendrites 12 similar in structures to that of the starting material. As shown in FIGS. 4 and 5, the composition formed by the present invention comprises fibers or solid cells 14 having a diameter smaller than that of the dendrites 12 from which they are derived.

The following examples illustrate the present invention.

EXAMPLE I

This example illustrates the process of this invention utilizing Mar M200+Hafnium alloy. 4 gram specimens were prepared from a section of directionally solidified Mar M200+Hafnium alloy. Additional specimens were prepared by melting a portion of the alloy and resolidifying in a modified Bridgman crystal growth apparatus. Each specimen was subsequently coated in alumina cement, placed within recrystallized alumina crucibles, reheated to the semi-solid temperature range and held isothermally. Furnace temperature was controlled to ±2° C. by a current feedback device coupled to a Pt Pt-10% Rh thermocouple set within the furnace wall. Preheat time was a maximum of 10 minutes. Specimen temperature was monitored by a second thermocouple adjacent to the specimen, and experiments were terminated by quenching into water. The results are set forth in Table 1.

Standard metallographic techniques were used to observe sections of the as-coarsened sample both parallel and perpendicular to the original directional structure. Volume fractions were determined by point counting, and surface area to volume ratio $S_v$ was determined by a line intercept technique outlined by J. E. Hilliard, "Ceramic Microstructures", John Wiley & Sons, Inc., New York, 1968. The average number of primary phase/eutectic intersections per unit length of a test line $\bar{P}_L$, was measured in a transverse section of each specimen $S_v$ was then calculated using:

$$S_v=(\pi/2)\bar{P}_L$$

The bulk of these experiments were performed on asreceived airfoil sections. A typical transverse section, normal to the dendrite growth axis shows the primary dendrite arm spacing is approximately 290 μm and the structure contains about 0.25 volume fraction second phase. Appreciable tertiary dendrite arm development can be seen. For comparison, a specimen which had been prepared by completely remelting and growing in a modified Bridgman crystal grower had a primary dendrite arm spacing of approximately 90 μm and a volume fraction second phase of about 0.18, consistent with the growth velocity of 30 cm/hr and temperature gradient of 300° C./cm$^{-1}$.

A preliminary series of isothermal holds for 30 minutes at temperatures within the range 1290–1345° C. were used to generate a volume fraction solid versus temperature curve which then provided the basis for the remaining experimental series listed in Table 1.

At temperatures less than 1310° C. (which corresponds to 0.75 volume friction solid), the liquated interdendritic channels are discontinuous. With prolonged isothermal holding, substantial coarsening and coalescence of tertiary and secondary dendrite arms occurs but without any significant tendency towards a basic cellular structure of isolated primary phase rods.

As the isothermal holding temperature increases above 1310° C., (and the volume fraction liquid increases), dendrite arm coarsening and coalescence accelerates. Tertiary and secondary dendrite arms anneal and coalesce to form a plate-like morphology, which with increasing holding time tend to separate from the central primary dendrite spine. Subsequently, this structure then ripens with increasing time to relatively smooth surfaced, rod-like structures.

For practical considerations, an important parameter for "cellular in situ composites" is the mean fiber or cell spacing, or the number of fibers or cells per cross sectional area. This parameter also provides a useful technique for characterizing the microstructural changes which occur during the isothermal hold. The specimens with the faster growth rate and finer primary dendrite arm spacing exhibit more pronounced "fiber multiplication" (i.e. each primary dendrite degenerates into more "cells") than those specimens with the slower growth rate and larger primary dendrite arm spacing.

TABLE I

| Sample | Coars. Temp. °C. | Coars. Time (min.) | Initial Primary Spacing (μm) | Primary Arms/mm$^2$ | $S_v$(mm$^{-1}$) |
|---|---|---|---|---|---|
| 1 | 1307 | 30 | 290 | 14.00 | 15.02 |
| 2 | 1312 | 180 | 290 | 11.81 | 10.67 |
| 3 | 1327 | 30 | 290 | 14.30 | 14.32 |
| 4 | 1325 | 90 | 290 | 12.13 | 11.92 |
| 5 | 1320 | 180 | 290 | 10.03 | 9.72 |
| 6 | 1334 | 50 | 290 | 11.19 | 12.86 |
| 7 | 1332 | 180 | 290 | 12.43 | 11.64 |
| 8 | 1334 | 300 | 290 | 10.26 | 9.20 |
| 9 | 1347 | 30 | 290 | 17.40 | 13.84 |
| 10 | 1347 | 30 | 290 | 16.55 | 12.50 |
| 11 | 1343 | 50 | 290 | 13.10 | 11.26 |
| 12 | 1345 | 300 | 290 | 7.32 | 8.26 |

TABLE I-continued

| Sample | Coars. Temp. °C. | Coars. Time (min.) | Initial Primary Spacing (μm) | Primary Arms/mm² | $S_v(mm^{-1})$ |
|---|---|---|---|---|---|
| 13 | 1365 | 50 | 290 | 11.66 | 8.60 |
| 14 | 1343 | 1 | 290 | 14.60 | 17.90 |
| 15 | 1340 | 0.5 | 90 | 73.15 | 48.24 |
| 16 | 1347 | 1 | 90 | 85.00 | 42.65 |
| 17 | 1348 | 15 | 90 | 101.20 | 30.04 |
| 18 | 1350 | 30 | 90 | 89.75 | 20.00 |
| 19 | 1348 | 120 | 90 | 49.00 | 14.50 |

As shown in Table I, the process is favored by fine primary dendrite arm spacing. Presumably this is because the finer secondary dendrite arm/primary dendrite arm connections are more easily broken. These data therefore confirm that, in contrast with the production of in situ composites, the process of this invention is favored by high directional growth rates and low temperatures gradients with relatively short isothermal holding periods. The fine cell spacing which results in this way will also be beneficial from a mechanical property standpoint. Clearly, the optimum isothermal treatment depends upon the initial dendrite arm spacing. For the commercially grown structures with a dendrite arm spacing of 290 μm, the optimum treatment is 30 minutes at 1345° C. Maximum "fiber multiplication" and therefore fiber density is desirable and this suggests that higher initial dendrite growth velocities should be used, such as in the specimens completely resolidified. It is also likely that additional mechanical property benefits may be gained by aligning the residual phases which grow at the termination of the isothermal soaking stage. Such alignment may for example be achieved by controlled withdrawal into a chill zone. This also serves to minimize macrosegregation and pore formation which might be expected from a radial freezing pattern in the terminal solidification stage.

The driving force in this process is the reduction of surface area/volume ratio $S_v$, or more precisely the reduction of surface energy. For these experiments, $S_v$ shows a simple relationship with time (t) spent in the solid liquid region. Here, (t) is the total time which includes the initial solidification time of the specimen. Strictly, the relationship is $(S_v - S_{vo})\ \alpha$ function (t) where $S_{vo}$ is the initial value. For these experiments, the expression $S_v \alpha t^{-0.28}$ adequately describes all the data. From the data, it may be concluded that coarsening rate is independent of the primary arm spacing, or cooling rate, during manufacture. While increasing holding temperature does not change the net coarsening rate, the final fiber density is directly related to absolute coarsening temperature. Above some critical temperature the coarsening process changes from one in which each columnar dendrite coarsens as a single body, to one where the dendrite column degenerates into separate rods which further ripen with time.

What is claimed is:

1. The process for forming a metal composition containing cellular in situ composites from a first liquid metal composition which comprises cooling the first liquid metal composition at a fast growth rate and at a low temperature gradient to form a second metal composition containing aligned columnar dendrites and isothermally coarsening said second metal composition to anneal and coalesce tertiary and secondary dendrite arms and to convert the aligned columnar dendrites to cellular in situ composites.

2. The process of claim 1 wherein said growth rate is between about 5 $cm/hr^{-1}$ and 500 $cm/hr^{-1}$ and said temperature gradient is between about 0° $C./cm^{-1}$ and 300° $C./cm^{-1}$.

3. The process of claim 1 wherein the isothermally coarsened metal composition is cooled to form a solid metal composition.

4. The process of claim 2 wherein the isothermally coarsened metal composition is cooled to form a solid metal composition.

* * * * *